US009051845B2

(12) United States Patent
Bommanakatte et al.

(10) Patent No.: US 9,051,845 B2
(45) Date of Patent: Jun. 9, 2015

(54) SYSTEM FOR AXIAL RETENTION OF ROTATING SEGMENTS OF A TURBINE

(75) Inventors: Harish Bommanakatte, Bangalore (IN); Sheo Narain Giri, Bangalore (IN); David Randolph Spracher, Simpsonville, SC (US); Zachary James Taylor, Greenville, SC (US); Ryan Zane Ziegler, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 690 days.

(21) Appl. No.: 13/344,421

(22) Filed: Jan. 5, 2012

(65) Prior Publication Data

US 2013/0177429 A1 Jul. 11, 2013

(51) Int. Cl.
*F01D 5/32* (2006.01)
*F01D 5/30* (2006.01)

(52) U.S. Cl.
CPC ..... *F01D 5/3007* (2013.01); *Y10T 29/49321* (2015.01); *F01D 5/3053* (2013.01); *F01D 5/32* (2013.01)

(58) Field of Classification Search
CPC ..... F01D 5/3007; F01D 5/3053; F01D 5/32
USPC ..... 416/220 R
See application file for complete search history.

(56) References Cited

U.S. PATENT DOCUMENTS 2,843,356 A * 7/1958 Hull, Jr. ..... 416/144
3,198,485 A * 8/1965 Melenchuk ..... 416/220 R
3,202,398 A * 8/1965 Webb ..... 416/220 R
3,575,522 A * 4/1971 Melenchuk ..... 415/112
3,930,751 A * 1/1976 Straslicka et al. ..... 416/220 R
4,094,615 A 6/1978 Glenn
4,527,952 A 7/1985 Forestier et al.
4,566,857 A 1/1986 Brumen
4,676,723 A 6/1987 Kiger et al.
4,767,275 A 8/1988 Brown
4,883,405 A * 11/1989 Walker ..... 415/137
4,915,587 A * 4/1990 Pisz et al. ..... 416/220 R
5,151,013 A 9/1992 Moore
6,109,877 A 8/2000 Gekht et al.
6,533,550 B1 3/2003 Mills
6,837,686 B2 1/2005 Di Paola et al.
7,244,105 B2 7/2007 Moeller
7,309,215 B2 12/2007 Neguiescu
7,442,011 B2 10/2008 Negulescu et al.
8,070,431 B2 * 12/2011 Harter et al. ..... 415/209.3
2009/0290983 A1 * 11/2009 Tanaka ..... 416/179
2010/0178160 A1 7/2010 Liotta et al.

OTHER PUBLICATIONS

U.S. Appl. No. 13/344,296, filed Jan. 5, 2012, Spracher et al.

* cited by examiner

*Primary Examiner* — Nathaniel Wiehe
*Assistant Examiner* — Brian O Peters
(74) *Attorney, Agent, or Firm* — Fletcher Yoder, P.C.

(57) ABSTRACT

A turbomachine system includes a turbomachine that includes a rotor that includes a rotational axis, a first rotating segment having a first mating axial mount coupled to a first axial mount of the rotor in a first installed position and a first pin configured to insert into a first inserted position in both a first slot in the rotor and a first mating slot in the first rotating segment. The first pin in the first inserted position is configured to block axial movement of the first mating axial mount relative to the first axial mount. The turbomachine also includes a second rotating segment having a second mating axial mount coupled to a second axial mount of the rotor in a second installed position. The second rotating segment in the second installed position is configured to block removal of the first pin.

19 Claims, 9 Drawing Sheets

SYSTEM FOR AXIAL RETENTION OF ROTATING SEGMENTS OF A TURBINE

BACKGROUND OF THE INVENTION

The subject matter disclosed herein relates to turbomachinery, and more specifically, to axial retention of rotating segments of the turbomachinery.

A variety of turbomachines, such as compressors and turbines, include rotary blades. For example, a turbine, such as a gas turbine or a steam turbine, may include a plurality of rotary blades coupled to a rotor. Similarly, a compressor may include a plurality of rotary blades coupled to a rotor. A gas turbine engine typically includes a compressor section, a combustor section, and a turbine section. In each type of turbomachine, a retention system may be utilized to ensure the rotary blades remain coupled to the rotor. However, these retention systems may be complex, making the assembly and/or disassembly of the rotary blades from the rotor complex.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a turbomachine system includes a turbomachine. The turbomachine includes a rotor that includes a rotational axis, a first rotating segment having a first mating axial mount coupled to a first axial mount of the rotor in a first installed position. The turbomachine also includes a first pin configured to insert into a first inserted position in both a first slot in the rotor and a first mating slot in the first rotating segment, wherein the first slot and the first mating slot extend in a first circumferential direction relative to the rotational axis, and the first pin in the first inserted position is configured to block axial movement of the first mating axial mount relative to the first axial mount. The turbomachine further includes a second rotating segment having a second mating axial mount coupled to a second axial mount of the rotor in a second installed position, wherein the second rotating segment in the second installed position is configured to block removal of the first pin.

In accordance with a second embodiment, a turbomachine system includes a turbomachine rotor. The turbomachine rotor includes multiple axial mounts spaced circumferentially about a rotational axis of the turbomachine rotor, wherein the multiple axial mounts include a first axial mount and a second axial mount disposed at a circumferential offset from one another, the first axial mount is configured to couple with a first mating axial mount of a first rotating segment in a first installed position, and the second axial mount is configured to couple with a second mating axial mount of a second rotating segment in a second installed position. The turbomachine rotor also include multiple pin slots spaced circumferentially about the rotational axis of the turbomachine rotor, wherein the multiple pin slots include a first pin slot in the rotor adjacent the first axial mount, the first pin slot extends in a first circumferential direction relative to the rotational axis, the first pin slot extends in a first circumferential direction relative to the rotational axis, the first pin slot is configured to support the first pin in a first inserted position to block axial movement of the first mating axial mount relative to the first axial mount, and the second rotating segment in the second installed position is configured to block removal of the first pin.

In accordance with a third embodiment, a method of assembly includes axially inserting a first mating axial mount of a first rotating segment into a first axial mount of a rotor. The method also includes inserting a first pin in a first circumferential direction relative to a rotational axis of the rotor into a first slot of the rotor and a first mating slot of the first rotating segment into a first inserted position, wherein the first pin is configured to block axial movement of the first mating axial mount relative to the first axial mount. The method further includes axially inserting a second mating axial mount of a second rotating segment into a second axial mount of the rotor to block removal of the first pin.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
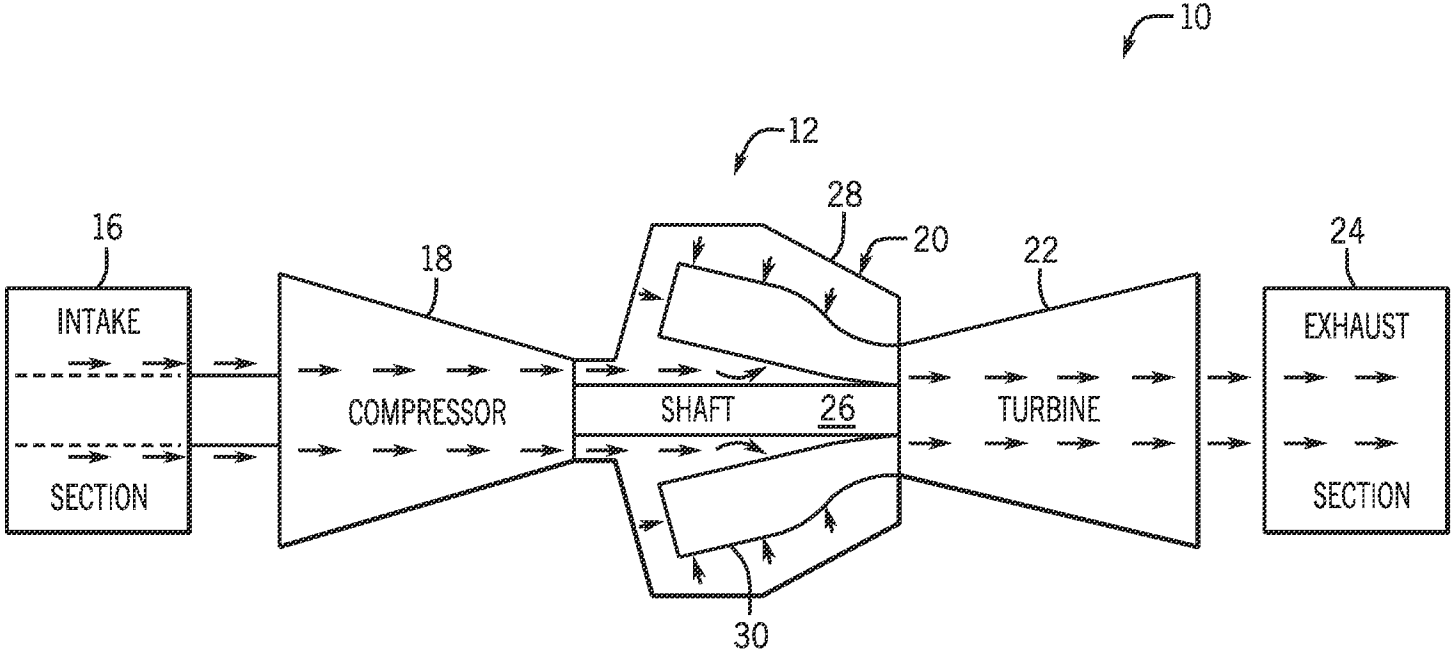
FIG. 1 is a schematic diagram of an embodiment of a turbomachine system (e.g., gas turbine engine) having an axial retention system for rotating segments.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to turbomachinery (e.g., gas turbine engines) that include an axial retention system to maintain rotating segments (e.g., blades/buckets or flow path seal) coupled to a rotor in components (e.g., compressor and/or turbine) of the turbomachine. In certain embodiments, the turbomachine includes a rotor having a rotational axis, a first rotating segment having a first mating axial mount coupled to a first axial mount of the rotor in a first installed position, and a first pin configured to insert into a first inserted position in both a first slot (e.g., recessed axial slot) in the rotor and a first mating slot (e.g., formed by a protruding axial joint) in the first rotating segment. The first slot and the first mating slot extend in a first circumferential direction relative to the rotational axis, and the first pin in the first inserted position is configured to block axial movement of the first mating axial mount relative to the first axial mount. The turbomachine also includes a second rotating segment having a second mating axial mount coupled to a second axial mount of the rotor in a second installed position, wherein the second rotating segment in the second installed position is configured to block removal of the first pin. In certain embodiments, the first pin is configured to insert into the first slot and the first mating slot in a first radial direction followed by the first circumferential direction relative to the rotational axis. For example, the first slot may have a radially accessible portion disposed in the rotor adjacent the first rotating segment, while the first mating axial mount is coupled to the first axial mount in the first installed position. The second rotating segment may cover the radially accessible portion of the first slot, while the second mating axial mount is coupled to the second axial mount in the second installed position. In some embodiments, the first slot in the rotor extends only a portion of a circumferential offset between the first and second axial mounts. The axial retention system may axially lock the rotating segments into the rotor to block disengagement of the rotating segments from the rotor due to centrifugal force loads. In addition, the axial retention system may provide a simple system for assembling and/or disassembling the rotating segments from the rotor.

FIG. 1 is a schematic diagram of a turbomachine system 10 including a gas turbine engine 12 having an axial retention system designed to axially secure rotating segments (e.g., blades/buckets or turbine flow path seals) to a rotor (e.g., turbomachine rotor or turbine rotor). In certain embodiments, the system 10 may include an aircraft, a watercraft, a locomotive, a power generation system, or combinations thereof. In addition, although the axial retention system described below may be described in the context of a gas turbine engine, the axial retention system may be utilized in other turbomachine systems such as a steam turbine, a hydro turbine, or a standalone compressor. The illustrated gas turbine engine 12 includes an air intake section 16, a compressor 18, a combustor section 20, a turbine 22, and an exhaust section 24. The turbine 22 is coupled to the compressor 18 via a shaft 26. The axial retention system may be utilized to secure the rotating segments to the rotor in the compressor 18 and/or turbine 22. As described in greater detail below, the axial retention system may axially lock the rotating segments into the rotor to block disengagement of the rotating segments from the rotor due to centrifugal force loads. In addition, the axial retention system may provide a simple system for assembling and/or disassembling the rotating segments from the rotor.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 between the compressor 18 and the turbine 22. The compressed air from the compressor 18 enters combustors 30 where the compressed air may mix and combust with fuel within the combustors 30 to drive the turbine 22.

From the combustor section 20, the hot combustion gases flow through the turbine 22, driving the compressor 18 via the shaft 26. For example, the combustion gases may apply motive forces to rotating segments (e.g., turbine rotor blades) within the turbine 22 to rotate the shaft 26. After flowing through the turbine 22, the hot combustion gases may exit the gas turbine engine 12 through the exhaust section 24.

Figure 2:
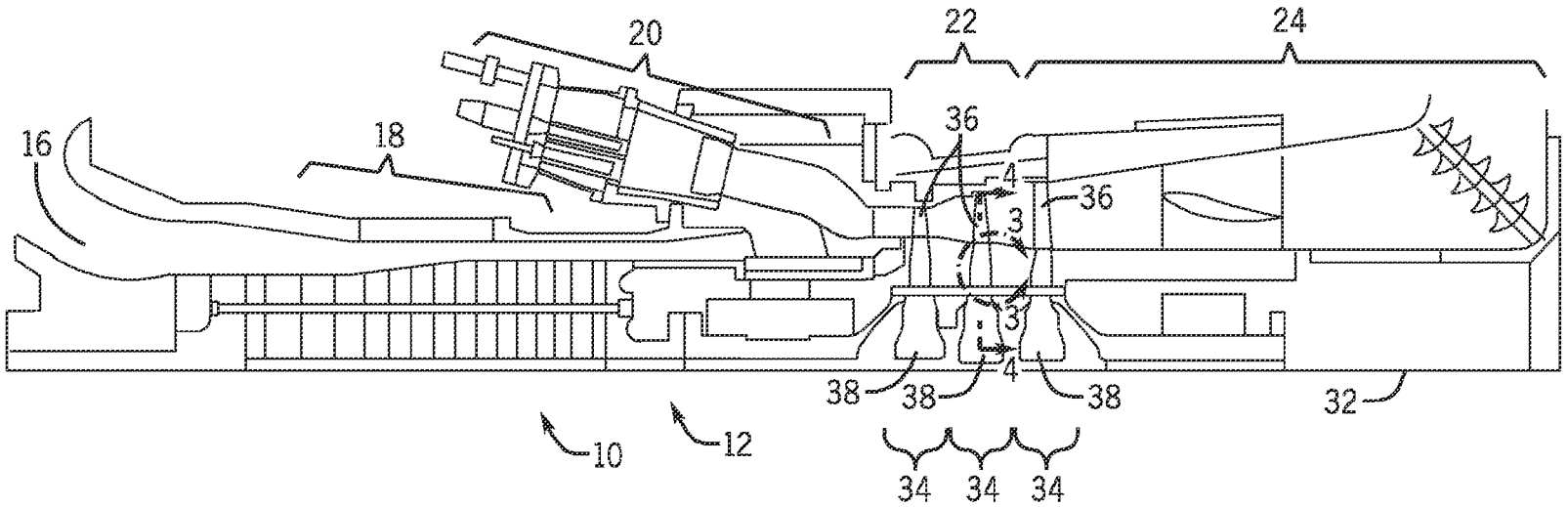
FIG. 2 is a cross-sectional side view of an embodiment of the turbomachine (e.g., gas turbine engine) of FIG. 1 taken along a longitudinal axis.

FIG. 2 is a cross-sectional side view of an embodiment of the gas turbine engine 12 of FIG. 1 taken along a longitudinal axis 32. As depicted, the gas turbine 22 includes three separate stages 34. Each stage 34 includes a set of blades or buckets 36 coupled to a rotor wheel 38 that may be rotatably attached to the shaft 26 (FIG. 1). The blades 36 extend radially outward from the rotor wheels 38 and are partially disposed within the path of the hot combustion gases. In certain embodiments, a set of flow path seals (e.g., turbine flow path seals; see FIG. 5) may be coupled to the rotor wheel 38. The axial retention system axially secures the blades 36 and/or flow path seals to the rotor wheels 38. Although the gas turbine 22 is illustrated as a three-stage turbine, the axial retention system described herein may be employed in any suitable type of turbine with any number of stages and shafts. For example, the axial retention system may be included in a single stage gas turbine, in a dual turbine system that includes a low-pressure turbine and a high-pressure turbine, or in a steam turbine. Further, the axial retention system described herein may also be employed in a rotary compressor, such as the compressor 18 illustrated in FIGS. 1 and 2.

As described above with respect to FIG. 1, air enters through the air intake section 16 and is compressed by the compressor 18. The compressed air from the compressor 18 is then directed into the combustor section 20 where the compressed air is mixed with fuel. The mixture of compressed air and fuel is generally burned within the combustor section 20 to generate high-temperature, high-pressure combustion gases, which are used to generate torque within the turbine 22. Specifically, the combustion gases apply motive forces to the blades 36 to turn the wheels 38 (i.e., rotor) about a rotational axis 32. In certain embodiments, the axial retention system may axially lock the rotating segments into the rotor 38 to block disengagement of the rotating segments from the rotor 38 due to centrifugal force loads. In addition, the axial retention system may provide a simple system for assembling and/or disassembling the rotating segments from the rotor 38.

Figure 3:
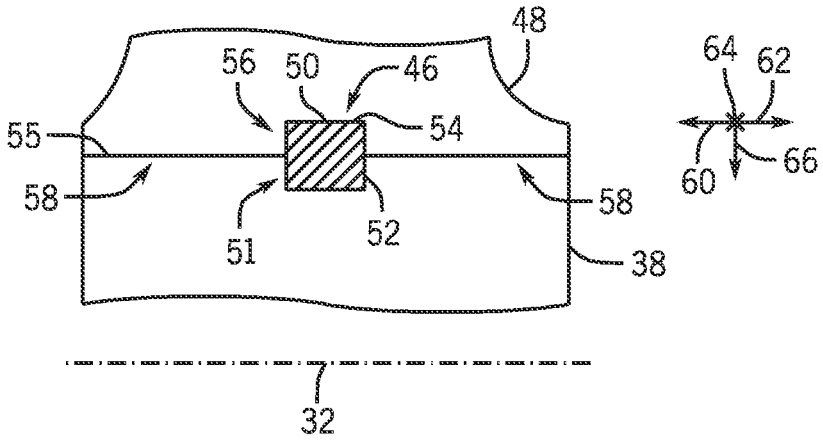
FIG. 3 is a partial cross-sectional view of an embodiment of the gas turbine engine of FIG. 2, taken within line 3-3, illustrating the axial retention system for the rotating segments.

FIG. 3 is a partial cross-sectional view of an embodiment of the gas turbine engine 12 of FIG. 2, taken within line 3-3, illustrating the axial retention system 46 for rotating segments 48. As depicted, the rotating segment 48 is coupled to the rotor 38 (e.g., wheel). The rotating segment 48 includes a mating axial mount 80 coupled to an axial mount 78 of the rotor 38 in an installed position (see FIGS. 4 and 5). The rotor 38 includes the rotational axis 32. For illustrative purposes, only a portion of the rotating segment 48 and rotor 38 are illustrated. The rotating segment 48 may include the bucket or blade 36 (see FIG. 4) or a turbine flow path seal (see FIG. 5).

The axial retention system 46 includes a pin 50 (e.g., shear pin) inserted into an inserted position 51 in both a slot 52 (e.g., pin slot) in the rotor 38 and a mating slot 54 (e.g., pin mating slot) in the rotating segment 48. The slot 52 and the mating slot 54 are each configured to support the pin 50 in the inserted position 51 to block axial movement of the mating axial mount 80 relative to the axial mount 78. In certain embodiments, the shape (e.g., cross-section) of the pin 50 may vary. For example, the pin 50 may include a square (as illustrated in FIG. 3), rectangular, oval, circular, triangular, T, U, or any other shape. The shape (e.g., cross-section) of the slot 52 and mating slot 54 may also vary to accommodate the shape of the pin 50. In some embodiments, the number of pins 50 and respective slots 52 and mating slots 54 may vary along a single interface 55 between the rotating segment 48 and the rotor 38. The number of pins 50 and respective slots 52 and mating slots 54 may each range from 1 to 10, 1 to 5, 1 to 3, or 1 to 2 along the interface 55. For example, the number for each of the pins 50 and respective slots 52 and mating slots 54 may be 1, 2, 3, 4, 5, 6, 7, 8, 9, 10, or any other number along the interface 55. In addition, the placement of the slot 52 and mating slot 54 may vary along the interface 55. For example, the slot 52 and respective mating slot 54 may be disposed along a central portion 56 of the interface 55, as illustrated, or offset from the central portion 56 towards an outer portion 58 of the interface in axial direction 60 and 62.

The slot 52 and mating slot 54 extend in a circumferential direction 64 relative to the rotational axis 32. In certain embodiments, the slot 52 and mating slot 54 may extend at an angle relative to the circumferential direction 64. As described in greater detail below, the slot 52 includes a radially accessible portion disposed in the rotor 38 adjacent the rotating segment 48 while the mating axial mount 80 is coupled to the axial mount 78 in the installed position. The pin 50 is configured to insert into the first slot 52 and the first mating slot 54 in a radial direction 66 followed by the circumferential direction 64 relative to the rotational axis 32. The pin 50 in the inserted position 51 is configured to block axial movement in directions 60 and 62 of the mating axial mount of the rotating segment 48 relative to the axial mount of the rotor 38. As described in greater detail below, the installation of another rotating segment 48 into the rotor 38 adjacent the pin 50 blocks removal of the pin 50. In certain embodiments, the axial retention system 46 may axially lock the rotating segments 48 into the rotor 38 to block disengagement of the rotating segments 48 from the rotor 38 due to centrifugal force loads. In addition, the axial retention system 46 may provide a simple system for assembling and/or disassembling the rotating segments 48 from the rotor 38.

Figure 4:
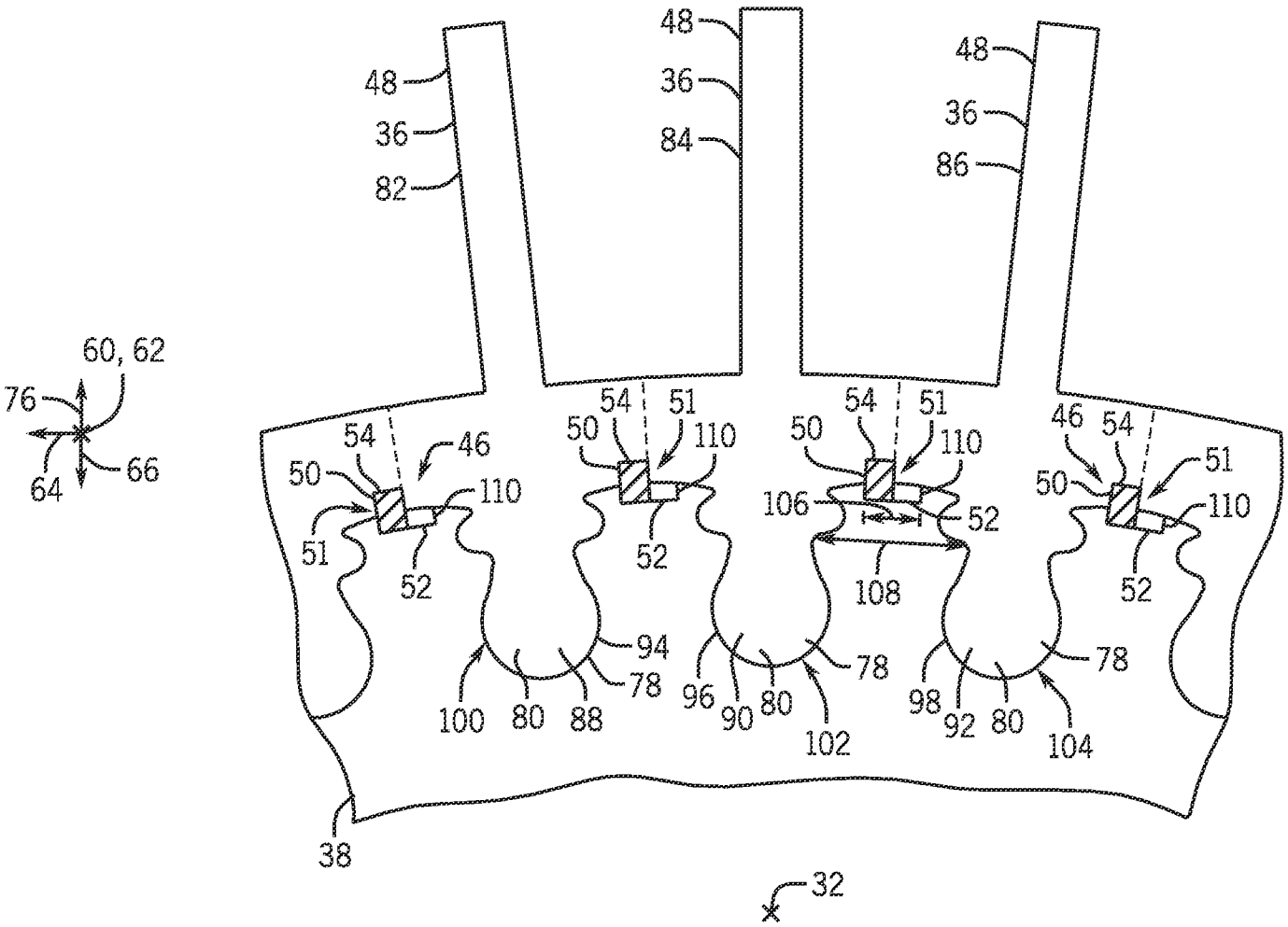
FIG. 4 is a partial cross-sectional view of an embodiment of the gas turbine engine of FIG. 2, taken along line 4-4, illustrating the axial retention system for multiple rotating segments (e.g., blades/buckets)

FIG. 4 is a partial cross-sectional view of an embodiment of the gas turbine engine 12 of FIG. 2, taken along line 4-4, illustrating the axial retention system 46 for multiple rotating segments (e.g. blades/buckets 36). As mentioned above, the axial retention system 46 may be utilized for blades 36 attached to rotors 38 in the compressor 18 and/or turbine 22. Each rotor 38 (e.g., circular rotor) includes blades 36 extending radially 76 outward from the rotor 38. The rotor 38 includes a plurality of axial mounts 78 (e.g., recessed axial slot or dovetail slot) for retaining a plurality of mating axial mounts 80 (e.g., protruding axial joint or mating dovetail joint) of the blades 36. In certain embodiments, approximately 50 to 150 blades 36 may be mounted and spaced or offset circumferentially 64 around the rotor 38 and the corresponding axis of rotation 32.

As illustrated, the blades 82, 84, and 86 have respective axial mating axial mounts 88, 90, and 92 coupled to respective axial mounts 94, 96, and 98 of the rotor 38 in installed positions 100, 102, and 104. The axial retention system 46 includes a plurality of slots 52 (e.g., pin slots) spaced circumferentially 64 about the rotational axis 32 of the rotor 38 (e.g., turbomachine rotor). The pins 50 are each inserted into inserted positions 51 in both the slots 52 in the rotor 38 and the mating slots 54 (e.g., pin mating slots) in the blades 82, 84, and 86. As mentioned above, each of the slots 52 and their respective mating slots 54 extend in the circumferential direction 64 relative to the rotational axis 32. Each pin 51 in the inserted position 51 is configured to block axial movement of the mating axial mounts 88, 90, and 92 in directions 60 and 62 relative to the axial mounts 94, 96, and 98. The blades 84 and 86 in their respective installed positions 102 and 104 block the removal of the pins 51 from slots 52 and mating slots 54 associated with the blades 82 and 84, respectively.

The slots 52 and mating slots 54 extend in the circumferential direction 64 relative to the rotational axis 32. In certain embodiments, the slots 52 and mating slots 54 may extend at an angle (e.g., approximately 0 to 60 degrees) relative to the circumferential direction 64. Each slot 52 extends only a portion 106 of a circumferential offset 108 between adjacent axial mounts 78. In certain embodiments, each slot 52 extends the entire portion 106 of the circumferential offset 108 between adjacent mounts (see FIG. 17). In addition, each slot 52 includes a radially accessible portion 110 disposed in the rotor 38 adjacent each blade 82, 84, and 86 while the respective mating axial mounts 88, 90, and 92 are coupled to the respective axial mounts 94, 96, and 98 in the installed positions 100, 102, and 104. When adjacent blades 84 and 86 are not disposed in installed positions 102 and 104, the radially accessible portion 110 (e.g., the portion associated with blade 82) is accessible for the insertion of the pin 50. Each pin 50 is configured to insert into each slot 52 and mating slot 54 in the radial direction 66 followed by the circumferential direction 64 relative to the rotational axis 32. The blades 84 and 86 cover the radially accessible portion 110 of the slots 52 while the respective mating axial mounts 90 and 92 are coupled to respective axial mounts 96 and 98 in the installed positions 102 and 104. The axial retention system 46 may axially lock the blades 36 into the rotor 38 to block disengagement of the blades 36 from the rotor 38 due to centrifugal force loads. In addition, the axial retention system 46 may provide a simple system for assembling and/or disassembling the blades 36 from the rotor 38.

Figure 5:
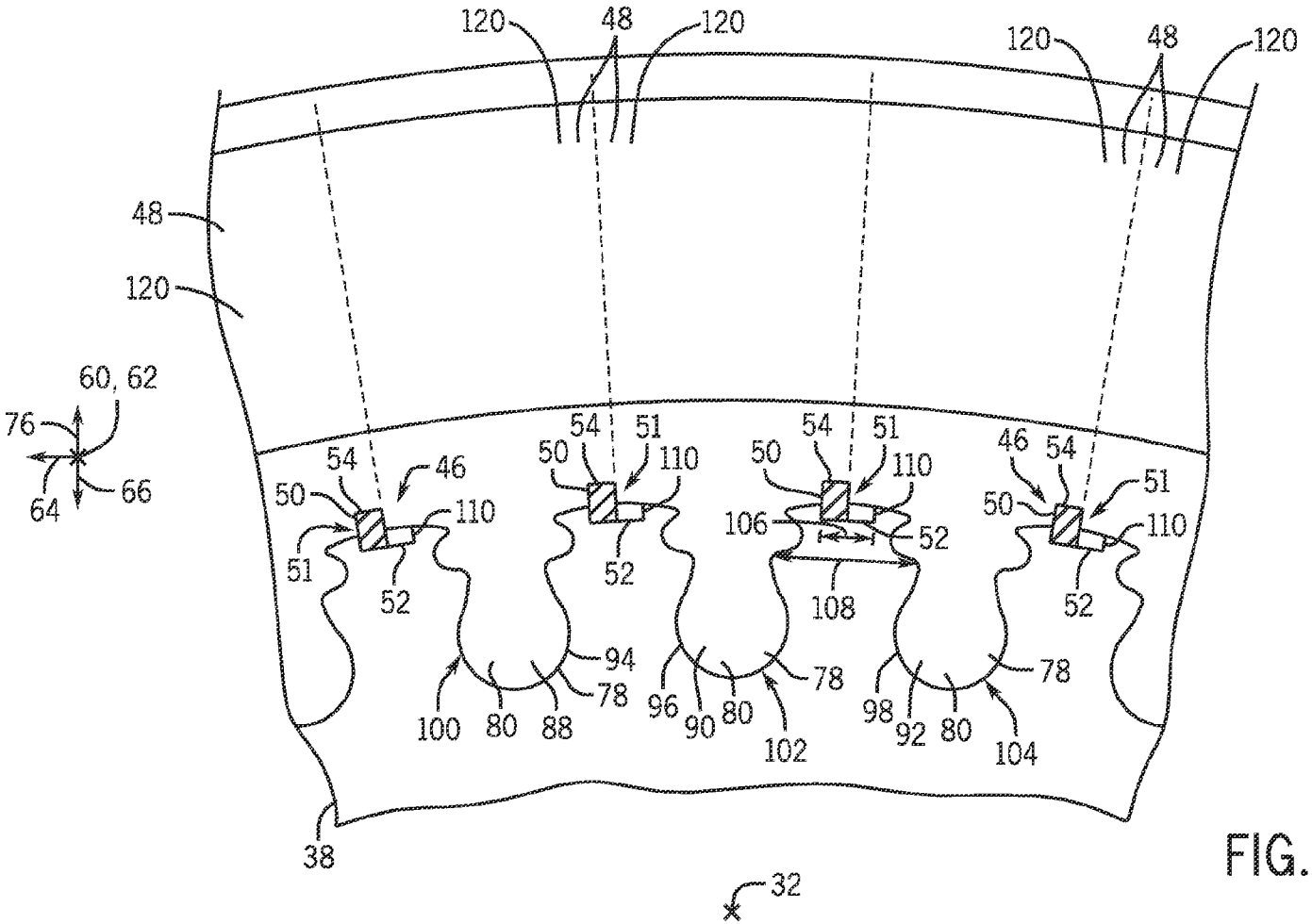
FIG. 5 is a partial cross-sectional view of an embodiment of the gas turbine engine of FIG. 2, taken along line 4-4, illustrating the axial retention system for multiple rotating segments (e.g., turbine flow path seals)

FIG. 5 is a partial cross-sectional view of an embodiment of the rotor 38 coupled to multiple turbine flow path seals 120 having the axial retention system 46 for the turbine flow path seals 120. The axial retention system 46 is as described in FIG. 4 except the rotor 38 is coupled to turbine flow path seals 120. In certain embodiments, approximately 50 to 150 turbine flow path seals 120 may be mounted and spaced or offset circumferentially 64 around the rotor 38 and the corresponding axis of rotation 32. The axial retention system 46 may axially lock the turbine flow path seals 120 into the rotor 38 to block disengagement of the seals 120 from the rotor 38 due to centrifugal force loads. In addition, the axial retention system 46 may provide a simple system for assembling and/or disassembling the seals 120 from the rotor 38.

Figure 6:
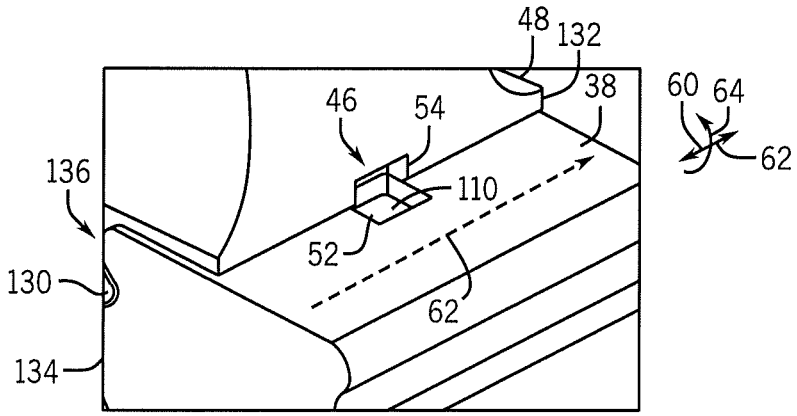
FIG. 6 is a partial perspective view of an embodiment of a rotor and a rotating segment illustrating the insertion of a first rotating segment into the rotor.

FIGS. 6-9 are partial perspective views of an embodiment of a rotor and one or more rotating segments 48 illustrating the assembly of the axial retention system 46. The rotor 38 and the rotating segments 48 are as described above. As illustrated in FIG. 6, a first mating axial mount 130 (e.g., protruding axial joint or mating dovetail joint) of a first rotating segment 132 (e.g., blade, bucket, or turbine flow path seal) is inserted in the axial direction 62 into a first axial mount 134 (e.g., recessed axial slot or dovetail slot) of the rotor 38 in a first installed position 136. As illustrated, the rotor 38 includes the slot 52 (e.g., pin slot) and the first rotating segment 132 includes the mating slot 54. In certain embodiments, the rotating segments 48 may be inserted generally in an axial direction 62 but at an angle or skewed relative to the rotational axis 32 of the rotor 38. As illustrated, the slot 52 includes the radially accessible portion 110 disposed in the rotor 38 adjacent the first rotating segment 132 while the first mating axial mount 130 is coupled to the first axial mount 134 in the first installed position 136. The slot 52 and mating slot 54 extend in the circumferential direction 64 relative to the rotational axis 32. The slot 52 and mating slot 54 are each configured to support the pin 50 in the inserted position 51 to block axial movement of the first mating axial mount 130 in the axial directions 60 and 62 relative to the first axial mount 134.

Figure 7:
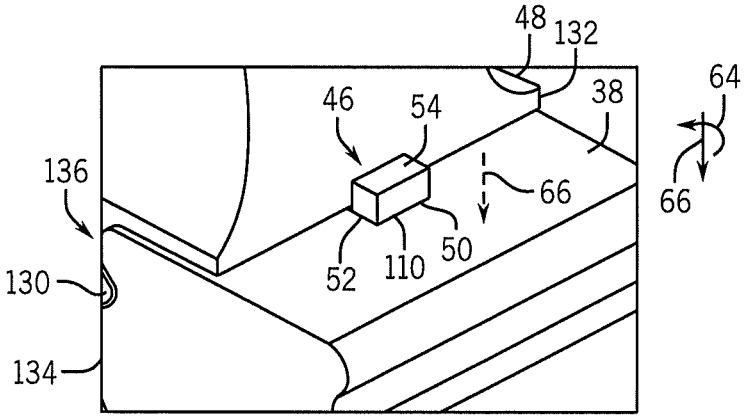
FIG. 7 is a partial perspective view of an embodiment of the rotor and the first rotating segment illustrating the insertion of a pin into a slot of the rotor.
Figure 8:
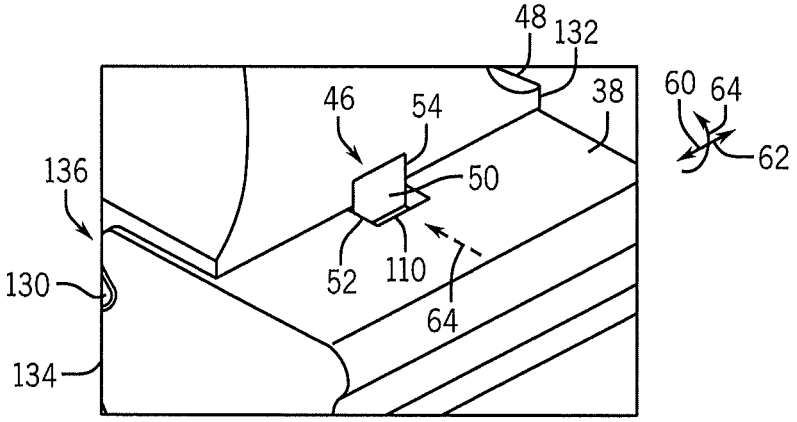
FIG. 8 is a partial perspective view of an embodiment of the rotor and the first rotating segment illustrating the insertion of the pin into the slot of the rotor and a mating slot in the first rotating segment.

As illustrated in FIG. 7, the pin 50 is then inserted in the radial direction 66 relative to the rotational axis 32 into the radially accessible portion 110 of the slot 52. Subsequent to insertion in the radial direction 66, the pin 50 is inserted in the circumferential direction 64 relative to the rotational axis 32 into the slot 52 and the mating slot 54 as illustrated in FIG. 8. The pin 50 is inserted in its entirety into the slot 52 and mating slot 54 so that no portion of the pin 50 extends into the radially accessible portion 110. The pin 50 in the installed position 51 blocks axial movement of the first mating axial mount 130 in the axial directions 60 and 62 relative to the first axial mount 134.

Figure 9:
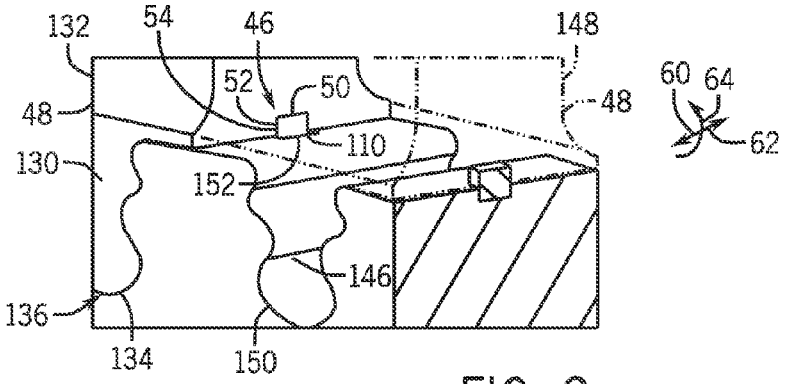
FIG. 9 is a partial perspective view of an embodiment of the rotor and the first rotating segment and a second rotating segment to secure the pin into slot of the rotor and mating slot in the first rotating segment.

Following insertion of the pin 50 into the slot 52 and the mating slot 54, a second mating axial mount 146 (e.g., protruding axial joint or mating dovetail joint) of a second rotating segment 148 (e.g., blade, bucket, or turbine flow path seal) is inserted in the axial direction 62 into a second axial mount 150 (e.g., recessed axial slot or dovetail slot) of the rotor 38 in a second installed position 152 as illustrated in FIG. 9. As depicted, the second rotating segment 148 in the second installed position 152 blocks removal of the pin 50. In addition, the second rotating segment 148 covers radially accessible portion 110 while disposed in the second installed position 152. Disassembly of the axial retention system 46 occurs in the reverse order of the assembly of the axial retention system 46. As illustrated, the rotor 38 includes the slot 52 (e.g., pin slot) and the first rotating segment 132 includes the mating slot 54. As illustrated, the slot 52 includes the radially accessible portion 110 disposed in the rotor 38 adjacent the first rotating segment 132 while the first mating axial mount 130 is coupled to the first axial mount 134 in the first installed position 136. The slot 52 and mating slot 54 extend in the circumferential direction 64 relative to the rotational axis 32. The slot and mating slot 54 are each configured to support the pin 50 in the inserted position 51 to block axial movement of the first mating axial mount 130 in the axial directions 60 and 62 relative to the first axial mount 134.

FIGS. 10-17 illustrate various embodiments of arrangements and shapes of the pins 50, slots 52 of the rotor 38, and mating slots 54 of the rotating segment 48 (e.g., blade, turbine, or turbine flow path seal) of the axial retention system 46. In particular, FIGS. 10-16 are partial cross-sectional views of an embodiment of the turbine engine 12 of FIG. 2, taken within line 3-3, of the pins 50, slots 52, and mating slots 54 of the axial retention system 46. As mentioned above, the axial retention system 46 is configured to block axial movement in directions 60 and 62 of the mating axial mount of the rotating segment 48 relative to the axial mount of the rotor 38. In particular, the axial retention system 46 may axially lock the rotating segments 48 into the rotor 38 to block disengagement of the rotating segments 48 from the rotor 38 due to centrifugal force loads. In addition, the axial retention system 46 may provide a simple system for assembling and/or disassembling the rotating segments 48 from the rotor 38. The embodiments below are not intended to be limiting, but rather the embodiments are intended to provide some examples of the various arrangements and shapes of the pins 50, slots 52, and mating slots 54.

Figure 10:
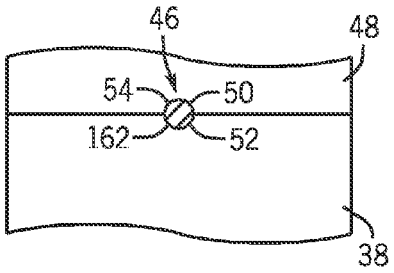
FIG. 10 is a partial cross-sectional view of an embodiment of the turbomachine of FIG. 2, taken within line 3-3, illustrating the axial retention system (e.g., circular shape) for the rotating segments.
Figure 11:
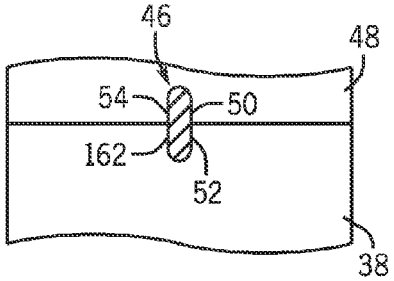
FIG. 11 is a partial cross-sectional view of an embodiment of the turbomachine of FIG. 2, taken within line 3-3, illustrating the axial retention system (e.g., oval) for the rotating segments.

The axial retention system 46 illustrated in FIGS. 9-13 may include a single pin 50 and corresponding slot 52 and mating slot 54. As illustrated in FIGS. 9 and 10 the pin 50 includes an elliptical cross-section. For example, the pin 50 includes a circular cross-section in FIG. 9 and an oval cross section in FIG. 10. The corresponding slot 52 and mating slot 54 form an elliptically-shaped recess 162.

Figure 12:
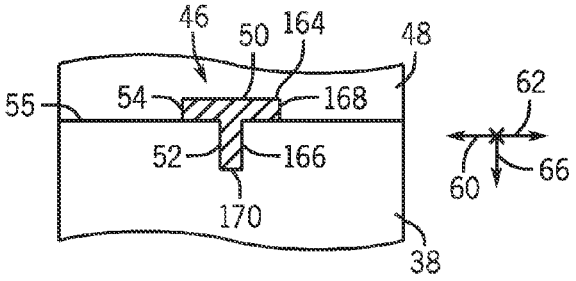
FIG. 12 is a partial cross-sectional view of an embodiment of the turbomachine of FIG. 2, taken within line 3-3, illustrating the axial retention system (e.g., T-shape) for the rotating segments.

Alternatively, the pin 50 may include a T-shape as illustrated in FIG. 12. The pin 50 includes a first portion 164 and a second portion 166. The first portion 164 runs along the interface 55 between the rotor 38 and rotating segment 48 in the axial directions 60 and 62. The second portion 166 extends in radial direction 66. As illustrated, the first portion 164 of the pin 50 associates with the mating slot 54 (e.g., rectilinear recess 168) and the second portion 166 associates with the slot 52 (e.g., rectilinear recess 170). In certain embodiments, the orientation of the pin 50 may be inverted to form an upside down T-shape, where the first portion 164 associates with the slot 52 and the second portion 166 associates with the mating slot 166.

Figure 13:
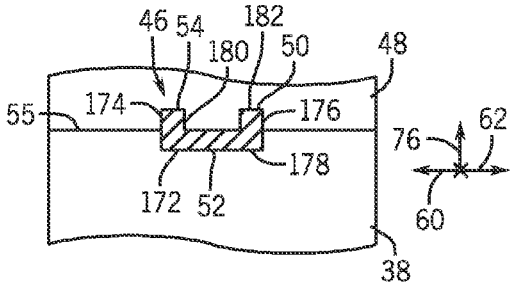
FIG. 13 is a partial cross-sectional view of an embodiment of the turbomachine of FIG. 2, taken within line 3-3, illustrating the axial retention system (e.g., U-shape) for the rotating segments.

As illustrated in FIG. 13, the pin 50 includes a U-shape. The pin 50 includes a base portion 172 and extension portions 174 and 176. The base portion 172 runs along the interface 55 between the rotor 38 and rotating segment 48 in the axial directions 60 and 62. The extension portions 174 and 176 extend in the radial direction 76. As illustrated, the base portion of the pin 50 associates with the slot 52 (e.g., rectilinear recess 178) and the extension portions 174 and 176 associate with the mating slot 54 (e.g., rectilinear recesses 180 and 182). In certain embodiments, the orientation of the pin 50 may be inverted to form an upside down U-shape, where the base portion 172 associates with the mating slot 54 and the extension portions 174 and 176 associate with the slot 52.

Figure 14:
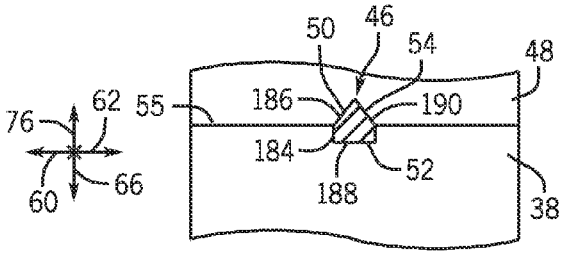
FIG. 14 is a partial cross-sectional view of an embodiment of the turbomachine of FIG. 2, taken within line 3-3, illustrating the axial retention system (e.g., pentagon) for the rotating segments.

As illustrated in FIG. 14, the pin 50 includes a pentagonal cross-section. The pin 50 includes a base portion 184 and a triangular portion 186. The base portion 184 runs along the interface 55 between the rotor 38 and rotating segment 48 in the axial directions 60 and 62. The triangular portion 186 tapers or narrows in the radial direction 76. As illustrated, the base portion 184 associates with the slot 52 (e.g., rectilinear recess 188) and the triangular portion 186 associates with the mating slot 54 (e.g., triangular recess 190). In certain embodiments, the orientation of the pin 50 may be inverted, where the triangular portion 186 associates with the slot 52 and tapers or narrows in the radial direction 66, and the base portion 184 associates with the mating slot 54.

Figure 15:
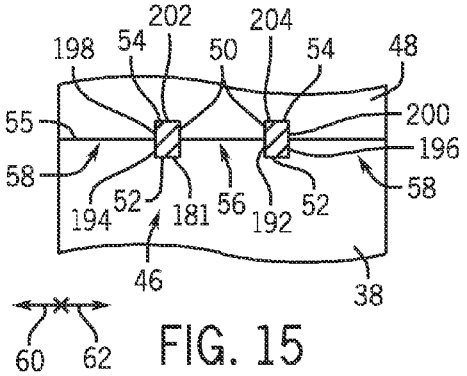
FIG. 15 is a partial cross-sectional view of an embodiment of the turbomachine of FIG. 2, taken within line 3-3, illustrating the axial retention system (e.g., multiple pins) for the rotating segments.

As illustrated in FIG. 15, the axial retention system 46 includes multiple pins 50 (e.g., pins 191 and 192) and corresponding slots 52 (e.g., slots 194 and 196) and mating slots 54 (e.g., mating slots 198 and 200) along the single interface 55 between the rotating segment 48 and the rotor 38. Each pin 190 and 192 includes a rectilinear cross-section (e.g., square). The slots 194 and 196 and respective mating slots 198 and 200 form rectilinear recesses 202 and 204. As mentioned above, the number of pins 50 and respective slots 52 and mating slots 54 may range from 1 to 10, 1 to 5, 1 to 3, or 1 to 2 each along the interface 55. For example, the number of pins 50 and respective slots 52 and mating slots 54 may be 1, 2, 3, 4, 5, 6, 7, 8, 9, 10, or any other number each along the interface 55. In addition, the placement of the slot 52 and mating slot 54 may vary along the interface 55. As illustrated, the slot 52 and respective mating slot 54 are disposed offset from the central portion 56 towards an outer portion 58 of the interface 55 in axial direction 60 and 62. In certain embodiments, the slot 52 and respective mating slot 54 may be disposed along a central portion 56 of the interface 55 (see FIGS. 10-14).

Figure 16:
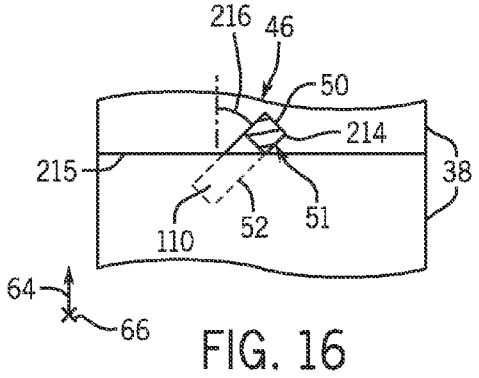
FIG. 16 is a partial cross-sectional top view of an embodiment of the rotor illustrating the axial retention system (e.g., angled slot) for the rotating segments.

FIG. 16 is a partial cross-sectional top view of an embodiment of the rotor 38 illustrating the axial retention system 46 (e.g., angled slot) for the rotating segments 48. The rotor 38 includes the slot 52 as described above. The slot 52 includes a portion 214 and the radially accessible portion 110. The portion 214 and radially accessible portion 110 are disposed on opposite sides of an interface 215 between adjacent rotating segments 48. The portion 214 is covered when a first rotating segment 48 is inserted into the installed position. As mentioned above, the pin 50 may be inserted first in the radial direction 66 into the radially accessible portion 110 of the slot 52 and then inserted in the circumferential direction 64 into portion 214 of the slot 52 into the inserted position 51. As illustrated in FIG. 16, the slot 52 (as well as the mating slot 54) extends in the circumferential direction 64 relative to the rotational axis 32. In particular, the slot 52 and mating slot 54 may extend at an angle 216 relative to the circumferential direction 64. The angle 216 may range from approximately 0 to 60 degrees, 0 to 45 degrees, 0 to 30 degrees, 0 to 15 degrees, 15 to 30 degrees, 30 to 45 degrees, and any subrange therein. For example, the angle 216 may be approximately 0, 5, 10, 15, 20, 25, 30, 35, 40, 45, 50, 55, or 60 degrees, or any other angle.

Figure 17:
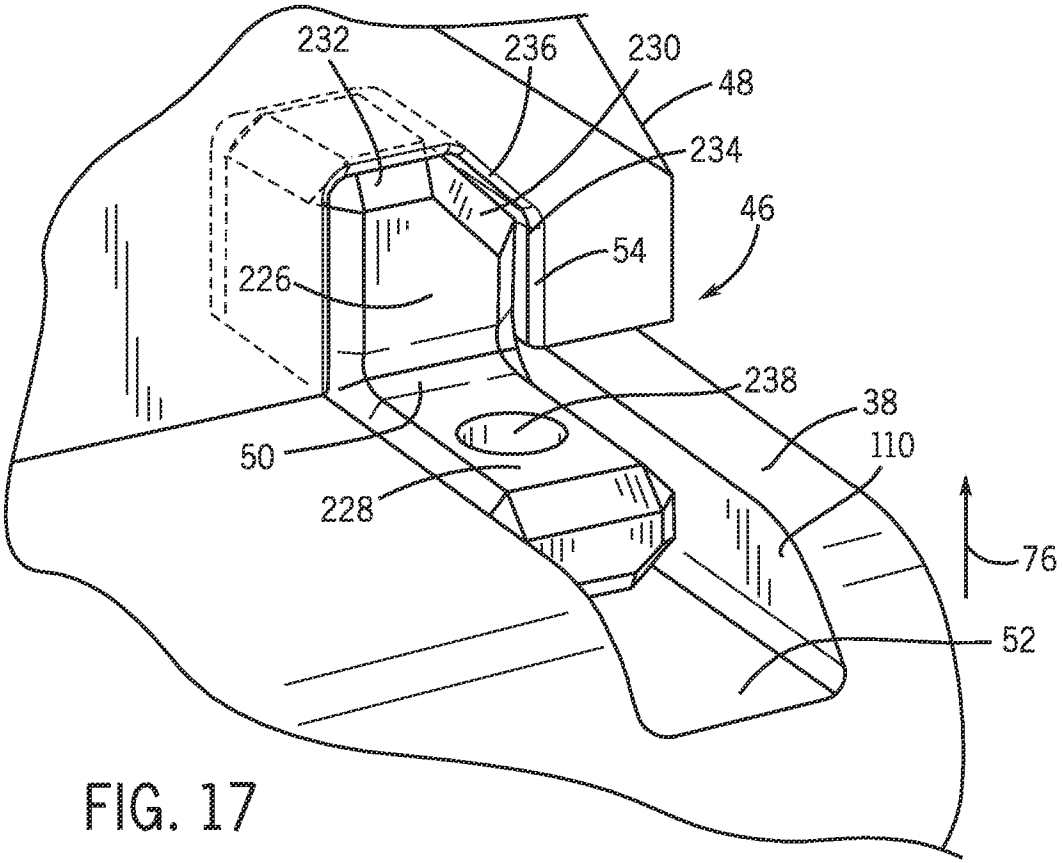
FIG. 17 is a partial perspective view of an embodiment of the rotor and a rotating segment illustrating the axial retention system (e.g., L-shaped pin).

FIG. 17 is a partial perspective view of an embodiment of the rotor 38 and the rotating segment 48 illustrating the axial retention system 46 (e.g., L-shaped pin) with the pin 50 in the inserted position to prevent axial movement of rotating segment 48 relative to the rotor 38. In general, the axial retention system 46 of FIG. 17 functions as described in the above embodiments. The pin 50 includes an L-shape that includes an upper portion 226 and a lower portion 228. The upper portion 226 includes an angled side 230 that tapers or narrows generally in radial direction 76 towards an end 232 (e.g., tapered end) of the upper portion 226 of the pin 50. As illustrated, the upper portion 226 of the pin 50 associates with the mating slot 54. The mating slot 54 includes a recess 234 that includes a tapered portion 236 that prevents the pin 50 from being inserted backwards into the mating slot 54 (i.e., prevents the insertion of the lower portion 228 into the mating slot 54). Also, as illustrated, the lower portion 228 of the pin 50 associates with the slot 52. In particular, the lower portion 228 of the pin 50 extends into the radially accessible portion 110 of the slot 52 while in the inserted position. As illustrated, in certain embodiments, the slot 52 extends the entire portion 106 of the circumferential offset 108 between adjacent axial mounts 78 (see FIG. 4). The lower portion 228 of the pin 50 includes a hole 238 that enables a tool to remove the pin 50 from the inserted position, e.g., during the disassembling of the rotating segments 48 from the rotor 38.

Technical effects of the disclosed embodiments include the axial retention system 46 to maintain the rotating segments 48 (e.g., blades, buckets, or flow path seal) coupled to the rotor 38 in components (e.g., compressor 18 and/or turbine 22) of the turbomachine 10 (e.g., gas turbine engines 12). Specifically, the axial retention system 46 includes the pin 51 configured to insert into a first inserted position in both the slot 52 (e.g., recessed axial slot) in the rotor 38 and the mating slot 54 (e.g., formed by a protruding axial joint) in the rotating segment 48. The slot 52 and the mating slot 54 extend in the circumferential direction 64 relative to the rotational axis 32 of the rotor 38, and the pin 50 in the inserted position 51 is configured to block axial movement of rotating segment 48 relative to the rotor 38. Insertion of another rotating segment 48 adjacent to the pin 50 blocks removal of the pin 50. The axial retention system 46 may axially lock the rotating segments 48 into the rotor 38 to block disengagement of the rotating segments 48 from the rotor 38 due to centrifugal force loads. In addition, the axial retention system 46 may provide a simple system for assembling and/or disassembling the rotating segments 48 from the rotor 38.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A turbomachine system, comprising:

a turbomachine, comprising:

a rotor comprising a rotational axis;

a first rotating segment having a first mating axial mount coupled to a first axial mount of the rotor in a first installed position;

a first pin configured to insert into a first inserted position in both a first slot in the rotor and a first mating slot in the first rotating segment, wherein the first slot and the first mating slot extend in a first circumferential direction relative to the rotational axis, and the first pin in the first inserted position is configured to block axial movement of the first mating axial mount relative to the first axial mount, wherein a first portion of the first slot in the rotor is radially aligned directly underneath the first mating slot, and a second portion has a radially accessible portion disposed in the rotor adjacent the first rotating segment while the first mating axial mount is coupled to the first axial mount in the first installed position;

and wherein the radially accessible portion comprises a recess defined by a bottom surface of the rotor, a surface of the first pin in the first inserted position, a first surface of the rotor, a second surface of the rotor, and a third surface of the rotor, and the surface of the first pin and the first, second and third surfaces of the rotor extend radially away from the bottom surface; and a second rotating segment having a second mating axial mount coupled to a second axial mount of the rotor in a second installed position, wherein the second rotating segment in the second installed position is configured to block removal of the first pin, and the first rotating segment in the first installed position and the second rotating segment in the second installed position together cover an entirety of the first slot.

2. The system of claim 1, wherein the turbomachine comprises a gas turbine engine.

3. The system of claim 1, wherein the first and second axial mounts each comprise a recessed axial slot, and the first and second mating axial mounts each comprise a protruding axial joint.

4. The system of claim 1, wherein the first pin is configured to insert into the radially accessible portion of the second portion of the first slot in a first radial direction followed by the first pin being inserted in a circumferential direction relative to the rotational axis into both the first portion of the first slot and the first mating slot.

5. The system of claim 1, wherein the second rotating segment covers the radially accessible portion of the first slot while the second mating axial mount is coupled to the second axial mount in the second installed position.

6. The system of claim 1, wherein the first slot in the rotor extends only a portion of a circumferential offset between the first and second axial mounts.

7. The system of claim 1, wherein the first and second rotating segments comprise a blade or flow path seal.

8. The system of claim 1, wherein the turbomachine comprises:

a second pin configured to insert into a second inserted position in both a second slot in the rotor and a second mating slot in the second rotating segment, wherein the second slot and the second mating slot extend in a second circumferential direction relative to the rotational axis, and the second pin in the second inserted position is configured to block axial movement of the second mating axial mount relative to the second axial mount; and a third rotating segment having a third mating axial mount coupled to a third axial mount of the rotor in a third installed position, wherein the third rotating segment in the third installed position is configured to block removal of the second pin.

9. A turbomachine system, comprising:

a turbomachine rotor, comprising:

a plurality of axial mounts spaced circumferentially about a rotational axis of the turbomachine rotor, wherein the plurality of axial mounts comprises a first axial mount and a second axial mount disposed at a circumferential offset from one another, the first axial mount is configured to couple with a first mating axial mount of a first rotating segment in a first installed position, and the second axial mount is configured to couple with a second mating axial mount of a second rotating segment in a second installed position; and a plurality of pin slots spaced circumferentially about the rotational axis of the turbomachine rotor, wherein the plurality of pin slots comprises a first pin slot in the turbomachine rotor adjacent the first axial mount, the first pin slot extends in a first circumferential direction relative to the rotational axis, a first portion of the first pin slot is configured to extend directly underneath a rotating segment portion of the first rotating segment when the first rotating segment is in the first installed position, a second portion of the first pin slot has a radially accessible portion disposed in the rotor adjacent the first rotating segment when the first rotating segment is in the first installed position and the second rotating segment is not disposed in the second installed position, the first pin slot is configured to support a first pin in a first inserted position to block axial movement of the first mating axial mount relative to the first axial mount, and the second rotating segment in the second installed position is configured to block removal of the first pin, and wherein the radially accessible portion comprises a recess defined by a bottom surface of the turbomachine rotor, a surface of the first pin when disposed in the first inserted position, a first surface of the turbomachine rotor, a second surface of the turbomachine rotor, and a third surface of the turbomachine rotor, and the surface of the first pin and the first, second and third surfaces of the turbomachine rotor extend radially away from the bottom surface.

10. The system of claim 9, wherein the turbomachine rotor comprises a turbine rotor.

11. The system of claim 9, wherein the first and second axial mounts each comprise a dovetail joint, and the first and second mating axial mounts each comprise a mating dovetail joint.

12. The system of claim 9, wherein the first pin slot in the turbomachine rotor extends only a portion of the circumferential offset between the first and second axial mounts.

13. The system of claim 9, wherein the radially accessible portion is configured to be covered by the second rotating segment while the second rotating segment is disposed in the second installed position.

14. The system of claim 9, wherein the first pin slot is configured to receive the first pin in a first radial direction followed by the first circumferential direction relative to the rotational axis.

15. The system of claim 9, comprising the first pin, the first rotating segment, and the second rotating segment, wherein the first pin is configured to insert into the first inserted position in both the first pin slot in the rotor and a first mating pin slot in the first rotating segment.

16. A method of assembly, comprising:

axially inserting a first mating axial mount of a first rotating segment into a first axial mount of a rotor;

inserting a first pin in a radial direction relative to the rotational axis of the rotor into a radially accessible portion of a first slot of the rotor;

inserting the first pin in a first circumferential direction relative to the rotational axis of the rotor into the first slot of the rotor and a first mating slot of the first rotating segment into a first inserted position, wherein a portion of the first slot in the rotor is radially aligned directly underneath the first mating slot, and wherein the first pin is configured to block axial movement of the first mating axial mount relative to the first axial mount, and wherein the radially accessible portion comprises a recess defined by a bottom surface of the rotor, a surface of the first pin in the first inserted position, a first surface of the rotor, a second surface of the rotor, and a third surface of the rotor, and the surface of the first pin and the first, second and third surfaces of the rotor extend radially away from the bottom surface; and axially inserting a second mating axial mount of a second rotating segment into a second axial mount of the rotor to block removal of the first pin.

17. The method of claim 16, wherein the first pin comprises an L-shape having an upper portion and a lower portion, the lower portion comprises a hole configured to enable removal of the first pin from the first slot, the upper portion comprises a tapered end, and the first mating slot comprises a recess having a tapered portion configured to enable the insertion of the tapered end of the upper portion of the first pin into the first mating slot and to prevent the insertion of the lower portion of the first pin into the first mating slot.

18. The method of claim 16, comprising:

inserting a second pin in a second circumferential direction relative to the rotational axis of the rotor into a second slot of the rotor and a second mating slot of the second rotating segment into a second inserted position; and axially inserting a third mating axial mount of a third rotating segment into a third axial mount of the rotor to block removal of the second pin.

19. The system of claim 1, wherein a first length of the first slot in the first circumferential direction is greater than a second length of the first mating slot in the first circumferential direction.

* * * * *